United States Patent [19]

Tilly et al.

[11] Patent Number: 4,475,463

[45] Date of Patent: Oct. 9, 1984

[54] SINGLE AXLE TRUCK TRANSOM ASSEMBLY

[75] Inventors: Lynn K. Tilly, Allison Park, Pa.; Richard G. Schwartz, Munster, Ind.

[73] Assignee: AMSTED Industries Incorporated, Chicago, Ill.

[21] Appl. No.: 431,218

[22] Filed: Sep. 30, 1982

[51] Int. Cl.[3] ..... B61F 3/00; B61F 5/22; B61F 5/24

[52] U.S. Cl. ..... 105/208; 105/171; 105/199 S; 105/206 R

[58] Field of Search ..... 105/3, 171, 182 R, 199 S, 105/206, 208, 208.1, 208.2, 224 R

[56] References Cited

U.S. PATENT DOCUMENTS

| | | | |
|---|---|---|---|
| 930,215 | 8/1909 | McCauley | 105/208 X |
| 2,637,279 | 5/1953 | Charlton et al. | 105/208 |
| 2,907,283 | 10/1959 | Markestein et al. | 105/199 S |
| 3,151,575 | 10/1964 | Dickey et al. | 105/199 S X |
| 4,339,996 | 7/1982 | Brodeur et al. | 105/199 S X |

*Primary Examiner*—Howard Beltran

*Attorney, Agent, or Firm*—Fred P. Kostka

[57] ABSTRACT

The present structure provides for a plurality of members for maintaining a pair of laterally spaced side frames of a single axle truck in a squared relationship. The members are joined to the side frames by detach-safe connections, wherein latches are formed at the ends of the members to seatably engage with notches formed on brackets of the side frames.

2 Claims, 7 Drawing Figures

SINGLE AXLE TRUCK TRANSOM ASSEMBLY

BACKGROUND OF THE INVENTION

1. Field of Invention

The present invention relates to a railway truck and more particularly to a detach-safe connection between transversely disposed transom members and side frames of a single axle railway truck to maintain the side frames and the transom members in a substantially squared relationship.

2. Prior Art

Present design of a single axle railway truck generally include a single wheelset of which the outer end portions are journaled intermediate the ends of a pair of laterally spaced side frames. Each of the side frames is provided with a longitudinally extending body including a pair of transversely and inwardly projecting load carrying brackets located at the opposite ends of the body. A swingable arm is suspended from each of the brackets to support a transverse crosstie member.

Each end of the crosstie member generally has provided thereon a resilient support on which cross channels are supported. The cross channels support the underframe or center sill of a railway car body disposed thereon.

The single axle railway truck is designed to effectively transfer static and dynamic forces of the car body to the resilient devices through the cross channels, and from the cross channels to the side frames through the crosstie members, the swing arms and the load carrying brackets. The forces on the side frames are thus transferred to the journaled wheelset onto the rail. The laterally spaced side frames are maintained in a squared relationship by transversely disposed transom member means. The ends of a transom members are fixedly secured by welding or similar means to a pair of transversely and inwardly projecting and longitudinally aligned pads formed on the inside wall of the side frames. Brake linkages, shock absorbing devices and other truck accessories may be carried by the transoms to provide an effectively operating railway truck.

For a more detailed description of the single axle railway truck, reference is made to co-pending U.S. patent applications having Ser. Nos. 302,217 and 313,945 filed on Sept. 14, 1981 and Oct. 22, 1981 respectively and assigned to the assignee of the present invention.

The single axle truck as generally described above is subject to a wide range of static and dynamic forces during operation. For instance, when a truck is negotiating a turn, the side frames may experience relative longitudinal movement which results in bending and torsional stresses on the transoms. These stresses are transferred to the side frames through the connections with the transoms.

Heretofore the transoms have been connected to the side frames by means of a double butt weld to accommodate the various stresses associated with the normal operation of a railway truck. However, such connection may be subject to excessive stress under severe operating conditions tending to cause the transom to separate from the side frames. In addition it necessitates the use of extensive fixturing to align the side frames and transoms during welding and requires exacting welding procedures and inspection.

SUMMARY OF THE PRESENT INVENTION

By the present invention, it is proposed to provide an improved transom with a truck side frame which is constructed to minimize the possibility of separation of the transom from the side frame while simplifying the welded connection between these members.

This is accomplished generally by a latch arrangement including a bracket integrally formed with the side frame and an interlocking arrangement formed in the bracket and the transom so as to resist separation when twisting and shear forces are imposed thereon.

More specifically, the side frame bracket is formed with a pair of vertically opposing notches and the transom ends are formed with a projection or land which seats within the lower notch and a hook member within the upper notch. The interlocked transom and side frame are welded along the edges of the land and hook and the terminal end of the bracket.

The preferred embodiment of the present invention discloses a transom having a longitudinal body of I shaped cross sectional configuration. The transom may be formed by any conventional casting methods. The structure of the transoms may include mountings for carrying brake linkages, shock absorbing devices or the like.

DESCRIPTION OF THE PREFERRED EMBODIMENT

Figure 1:
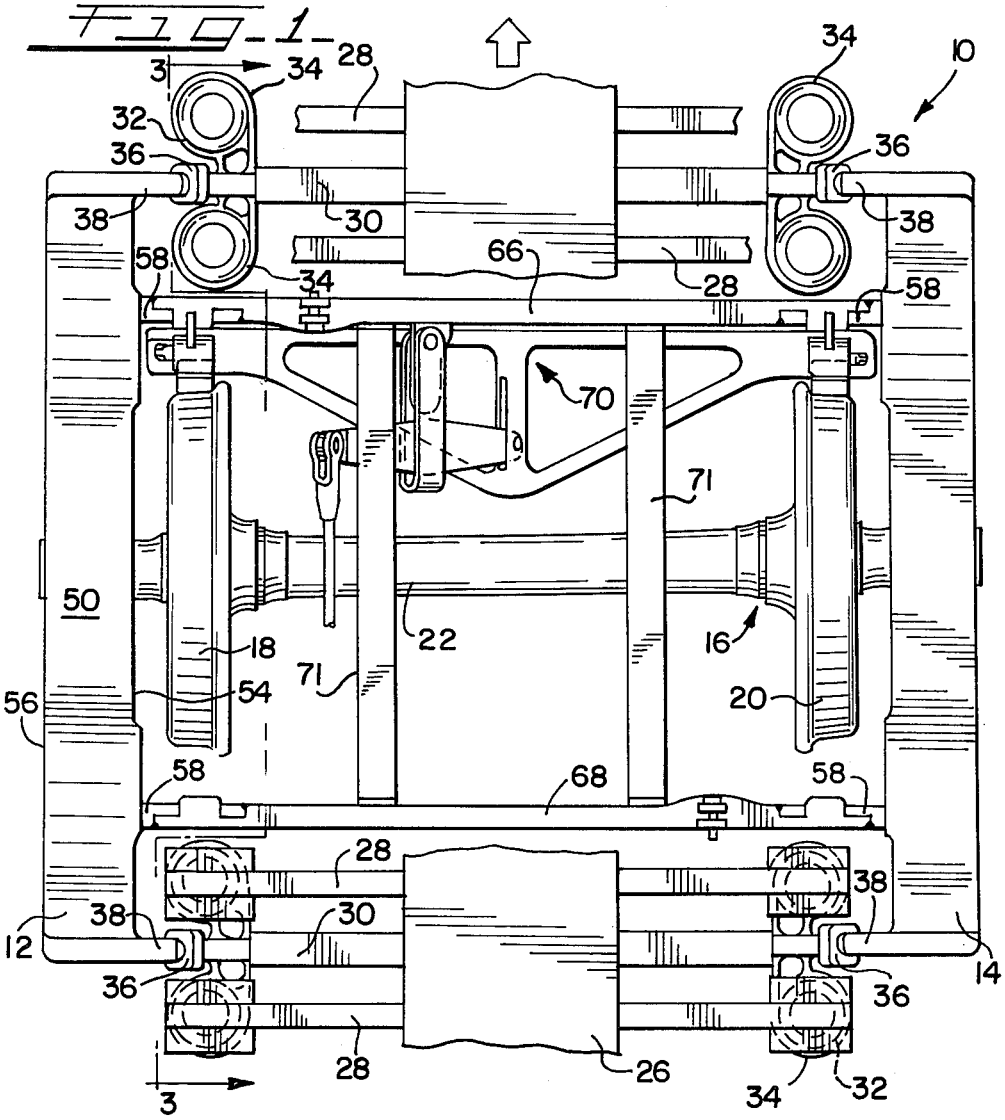
FIG. 1 is a plan view of a single axle railway truck embodying the structures of the invention, with parts partially broken away to show underlying details of structure.

Referring now to FIG. 1, there is shown a single axle railway truck 10 comprising a pair of laterally spaced side frames 12 and 14. A wheelset 16 including a pair of laterally spaced wheels 18 and 20 are mounted on axle 22 in a conventional manner and is generally disposed between the spaced side frames 12 and 14. The ends of axis 22 are journaled in a conventional manner between a pair of downwardly depending jaws 24 (FIG. 2) formed intermediate the end portion of the side frames.

Figure 3:
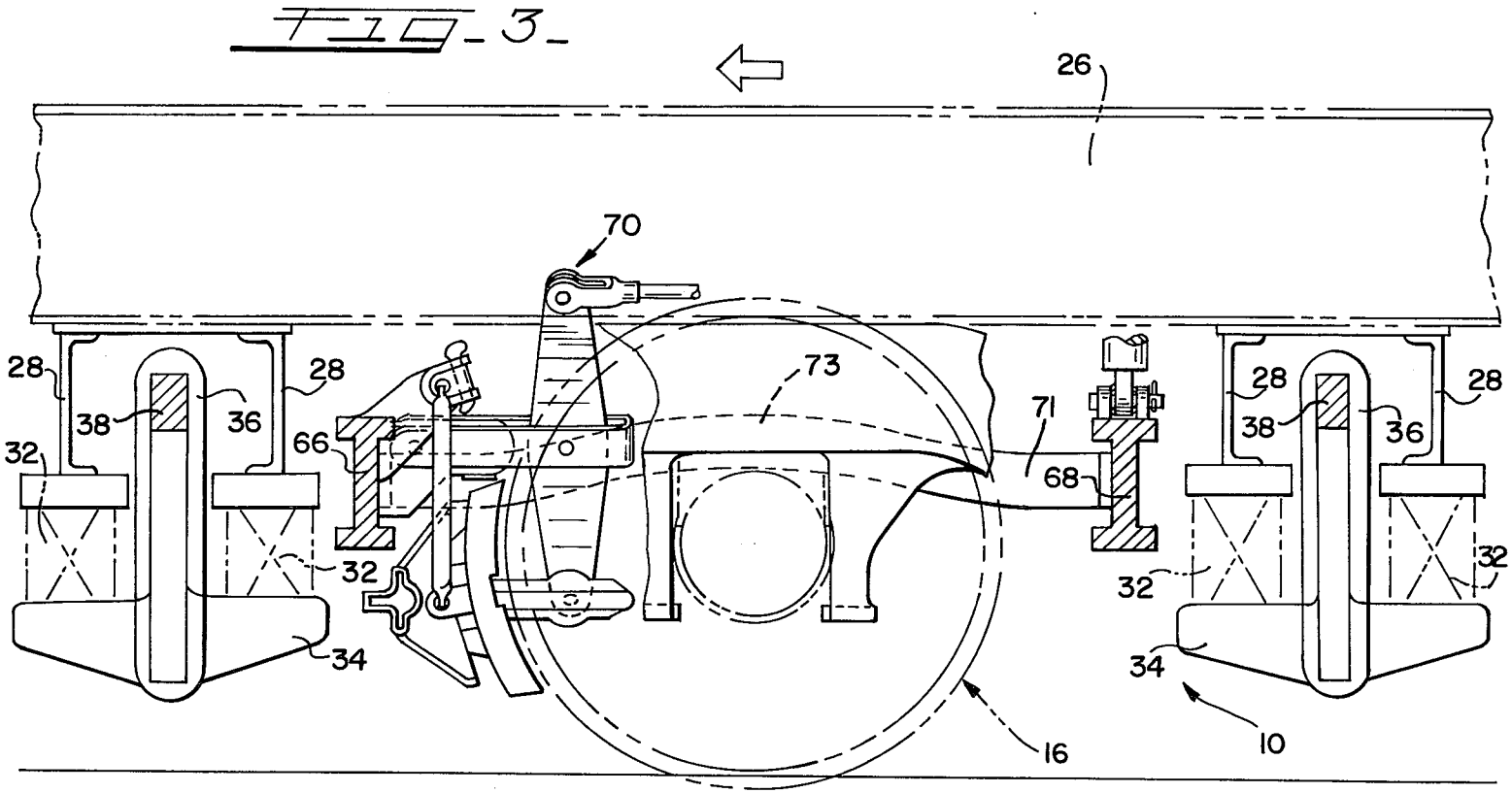
FIG. 3 is a partial side elevational view of a single axle truck along line 3—3 of FIG. 1.

In FIGS. 1 and 3, there is shown the underframe 26 of a car body (not shown) which includes cross channels 28 through which the vertical forces from the weight of the car body are transmitted to cross tie members 30 by way of resilient devices 32 carried on spring cups 34. Swing arms 36 are suspended from transversely and inwardly projecting brackets 38 formed at the opposite ends of the side frames 12 and 14. The ends of the cross tie member 30 are carried by the swing arm 36 to transmit forces from the cross tie member 30 to the side frames.

Figure 2:
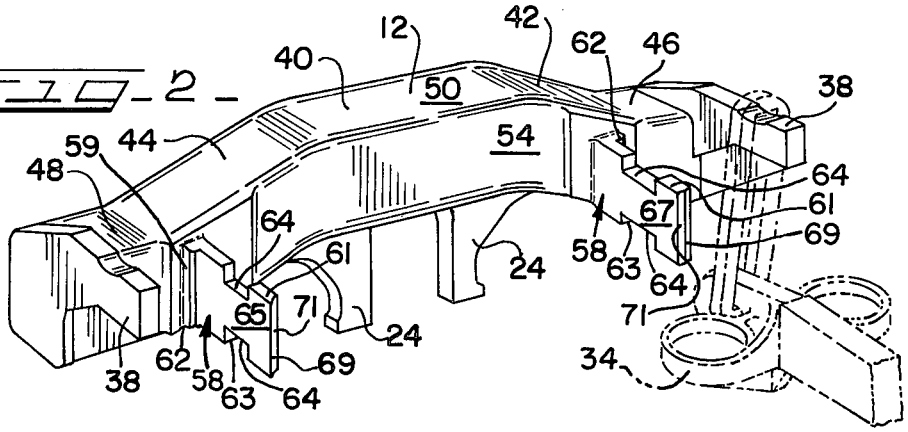
FIG. 2 is a perspective view of a side frame embodying the structures of the invention.

Side frame 12 as shown in FIG. 2 includes an elongated body having a central section 40 from the ends of which there depends downwardly sloping portions 42 and 44. Extending from the ends of the sloping portions 42 and 44 are horizontal end sections 46 and 48. The side frame 12 is of generally a hollow rectangular cross section including an upper wall 50 and a lower wall, joined by laterally spaced vertical inner and outer side walls 54 and 56.

As best seen in FIG. 2, projecting inwardly from each of the inner side walls are brackets 58. The bracket 58 is formed as an integral part of the respective inner side walls of the side frames 12 and 14, and includes a vertical reinforcing rib 62 disposed along the juncture between the bracket and the side frame. A vertical groove 59 is formed along rib 62 to receive weld and to secure the bracket 58 to the transom. The bracket 58 is of generally rectangular cross section including an upper wall 61 and a lower wall 63 joined by a pair of opposing side walls 65 and 67. The free end of the brackets 58 is formed with an end wall 69. A pair of vertically opposing notches 64 are formed on upper and lower walls 61 and 63 for interlocking with the end portion of a transom, as to be described hereinafter. A vertical groove 71 is formed along end wall 69 to receive a continuous weld when the bracket is interlocked with the transom.

Referring again to FIG. 1, transom members 66 and 68 connect two laterally opposed and longitudinally aligned brackets 58 at each of the ends of the side frames 12 and 14.

The transoms 66 and 68 serve to maintain the side frames 12 and 14 in a squared relationship. In addition, the transoms 66 and 68 may provide a support for linkages of a brake assembly 70, suspension device or the like. A pair of laterally spaced and longitudinally extending spreader tubes 71 are generally provided connecting the transoms 66and 68 so as to maintain the transoms in a squared relationship. The spreader tubes 71 may be of hollow cylindrical construction and are securely fastened to the transoms 66 and 68 by welding or other suitable devices. As shown in FIG. 3, spreader tube 71 may include center portion 73 having a higher elevation than its ends to be free from contact with the wheel axle when the tubes 71 are connected to the transoms.

Figures 4, 5:
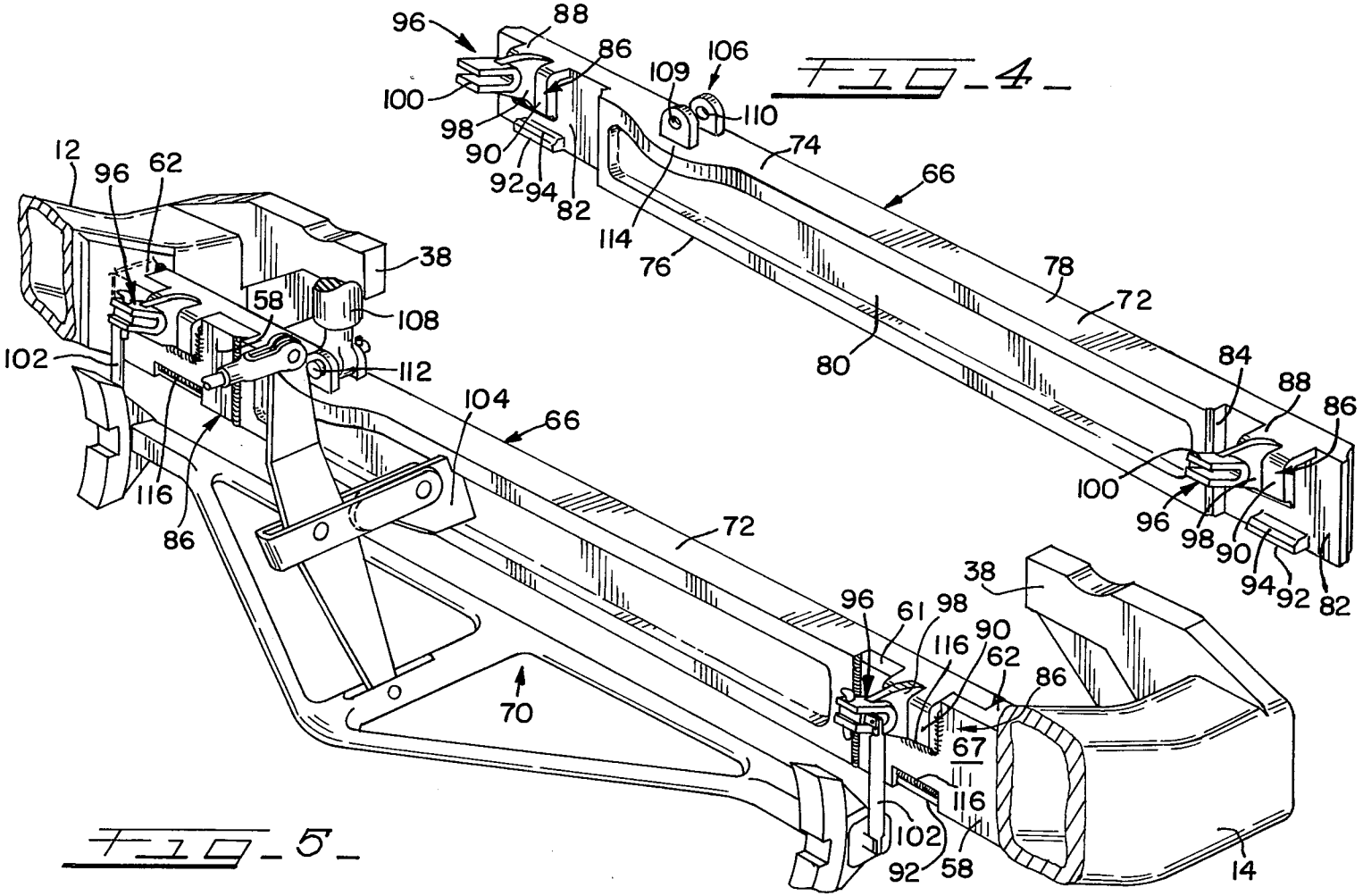
FIG. 4 is a perspective view of the transom of the single axle railway truck shown in FIGS. 1–3.
FIG. 5 is a fragmentary perspective view of the transom and side frames and showing the brake linkages connected to the transom.

As shown in FIGS. 4 and 5, the transom 66 may be formed with an I-shaped cross-sectional including a body 72 having an upper wall 74 and a lower wall 76 joined by a center web 80. Each end of the body 72 is provided with an integrally formed flange 82 longitudinally extending from the body 72 at an offset distance from the longitudinal axis of the body 72 so that the bracket 58, when interlocked with the flange 82, may be of substantially the same thickness as the body 72, as shown in FIG. 5. A lug assembly 86 comprising a horizontal arm 88 that extends integrally from the upper wall and an arm 90 downwardly depending therefrom. A land or lug 92 is formed in the lower portion of flange 82 vertically spaced and in alignment with the horizontal arm 88. Longitudinally extending groove 94 may be provided along land 92 to accommodate securements such as welding when the interlocking assembly 86 is connected to the bracket 58. The bracket 58 is interlocked with the flange 82 by placing upper arm 88 of lug assembly 86 in upper notch and the lower land 92 in lower notch (FIG. 5). This interlocking feature provides a secure connection between the side frames and the transom against forces acting in tension or compression on the transom. At the same time, overlapping of the bracket 58 and flange 82 provides structural reinforcement to the connection against bending or torsional forces on the transom. Securement such as welding 116 is generally applied along the junctures between the transom and the bracket to maintain the members permanently interlocked.

The transom 66 may include a brake linkage carrier 96 formed on the horizontal and downwardly depending arms 88 and 90. The brake linkage includes a supporter 98 connected to the horizontal arm 88 and the downwardly depending arm 90. A U-shaped carrier 100 having its open end disposed directly and slightly above the horizontal axis of the body 72, projects in a remote direction from its connecting supporter 98. As shown in FIG. 5, a brake linkage 102 is suspended from the carrier 100 and a pivot bracket 104 is connected to the body 72 in order to provide the necessary moment arm to operate the brake assembly 70. A suspension bracket 106 is provided on the top wall 74 of body 66 for carrying a suspension or shock absorbing device 108 of which the other end is connected to the car body (not shown). The suspension bracket 106 includes a pair of spaced mountings 109 having an aperture 110 for receiving a mounting bolt 112 of the suspension device 108. The top wall 74 has transversely extending protrusions 114 to accommodate the spaced mountings 109. It should be noted that the suspension bracket 106 is disposed in lateral alignment with the longitudinal axis of the body 66 so that any vertical force on the brackets 106 will not cause a rotational moment about the longitudinal axis.

Figures 6, 7:
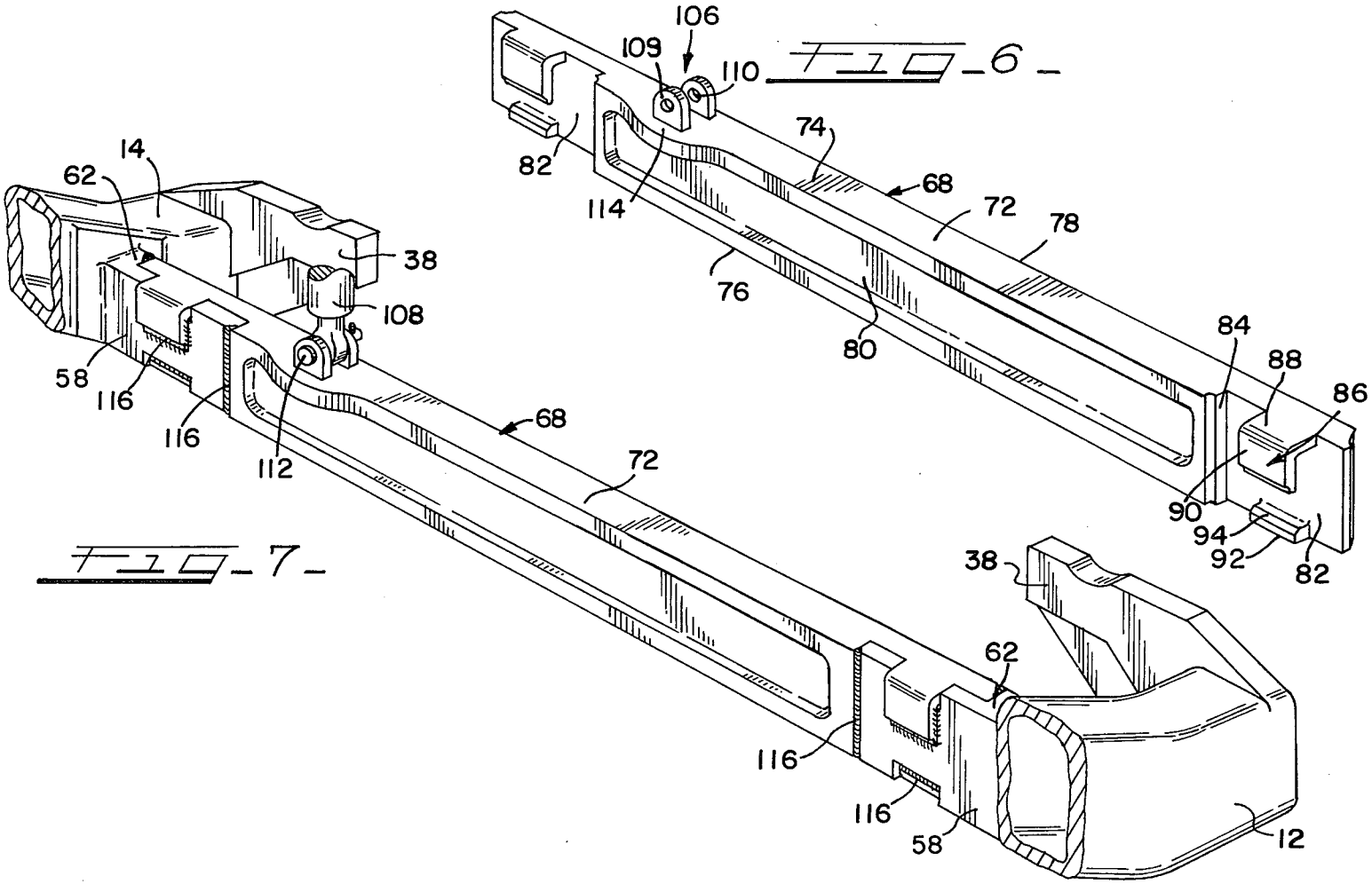
FIG. 6 is a perspective view of another embodiment of a transom for a single axle railway truck.
FIG. 7 is a fragmentary perspective view of the transom of FIG. 6 and side frames and having suspension devices connected thereto.

FIGS. 6 and 7 show the transom 68 having a suspension bracket 106 on the top wall 74 of body 72 for carrying a suspension or shock absorbing device 108. The structure and function of bracket 106 is similar to the bracket of transom 66 described above.

What is claimed is:

1. A railway car truck comprising a pair of laterally spaced side frames, a plurality of longitudinally spaced transom means including a top wall and a bottom wall extending between said side frames, and means connecting said transom means to said side frames, said connecting means including bracket means projecting from said side frames having a first notch means along an upper edge of said bracket and a second notch means along a lower edge of said bracket, and lug means provided on said ends of said transom means interlockingly engageable within said notch means, said lug means including a first longitudinally projecting arm connected to said transom top wall, a second arm downwardly dependent from said first arm, and a land means longitudinally depending from said bottom wall, said first arm being seatable in said first notch means with said depending arm overlying said transom and said land means being seatable in said second notch means of said bracket means when said transom means is connected to said bracket means, and a weld means fixing said lug means within said notch means.

2. The invention as described in claim 1 wherein said weld means comprises a plurality of welds disposed along the junctures between said brackets means and said transom means.

* * * * *